US007448240B1

(12) United States Patent
Huang et al.

(10) Patent No.: US 7,448,240 B1
(45) Date of Patent: Nov. 11, 2008

(54) LOCK ASSEMBLY

(75) Inventors: Chao-Ming Huang, Kaohsiung Hsien (TW); Chi-Ming Chen, Kaohsiung Hsien (TW)

(73) Assignee: Taiwan Fu Hsing Industrial Co., Ltd. (TW)

( * ) Notice: Subject to any disclaimer, the term of this patent is extended or adjusted under 35 U.S.C. 154(b) by 0 days.

(21) Appl. No.: 12/004,860

(22) Filed: Dec. 21, 2007

(30) Foreign Application Priority Data

Jun. 25, 2007 (TW) ..... 96122857 A

(51) Int. Cl.
*E05B 29/04* (2006.01)
*E05B 35/10* (2006.01)

(52) U.S. Cl. ..... 70/492; 70/340; 70/341; 70/360; 70/383; 70/384; 70/495

(58) Field of Classification Search ..... 70/337–343, 70/360, 361, 368, 382–385, 492–496, DIG. 22, 70/DIG. 75
See application file for complete search history.

(56) References Cited

U.S. PATENT DOCUMENTS 1,965,889 A * 7/1934 Fitz ..... 70/419
3,667,262 A * 6/1972 Hill ..... 70/384
4,376,382 A * 3/1983 Raymond et al. ..... 70/338
6,119,495 A * 9/2000 Loreti ..... 70/340
6,959,569 B2 * 11/2005 Strader et al. ..... 70/492
6,973,813 B2 * 12/2005 Erdely ..... 70/492
7,007,528 B2 * 3/2006 Chong et al. ..... 70/492
7,047,778 B2 * 5/2006 Dimig et al. ..... 70/495
7,162,901 B2 * 1/2007 Williams ..... 70/493
7,308,811 B2 * 12/2007 Armstrong et al. ..... 70/492
7,322,219 B2 * 1/2008 Armstrong et al. ..... 70/492
7,360,382 B2 * 4/2008 Fernandez ..... 70/360
2003/0089149 A1 * 5/2003 Suzuki et al. ..... 70/492
2004/0069030 A1 * 4/2004 Takadama ..... 70/495
2005/0011242 A1 1/2005 Armstrong et al.
2005/0016234 A1 * 1/2005 Strader et al. ..... 70/492
2005/0172687 A1 * 8/2005 Segien et al. ..... 70/493
2006/0117822 A1 * 6/2006 Boesel et al. ..... 70/495
2007/0101782 A1 * 5/2007 Shen ..... 70/495

* cited by examiner

*Primary Examiner*—Lloyd A Gall
(74) *Attorney, Agent, or Firm*—William E. Pelton, Esq.; Cooper & Dunham LLP

(57) ABSTRACT

A lock assembly has a housing, a lock cylinder, an adjusting block and an adjusting assembly. The adjusting block is slidably on the lock cylinder and has a wedge side facing the lock cylinder and a plurality of first wedge elements formed on the wedge side. The adjusting assembly is mounted in the lock cylinder and has multiple adjustable rack assemblies mounted in the lock cylinder. Each rack assembly has a rack element and an adjusting base. The rack element selectively abuts with a corresponding one of the lock pins and has a second wedge element selectively engaging one of the first wedge elements on the adjusting block. The adjusting base selectively engages the rack element.

18 Claims, 11 Drawing Sheets

LOCK ASSEMBLY

BACKGROUND OF THE INVENTION

1. Field of the Invention

The present invention relates to a lock assembly, and more particularly to a lock assembly that can be adjusted to fit with different keys conveniently and quickly.

2. Description of Related Art

A traditional lock assembly is only applied with a specific key and cannot fit with different keys. To use with different keys, an old lock cylinder should be replaced with a new one, such that the traditional lock assembly is not versatile in use.

To make a lock assembly fitting with different keys, a US Patent Application with publish number 2005/0011242 (referring to '242 application hereafter), entitled to "Rekeyable Lock Assembly" is provided. The '242 application comprises a plug body and carrier sub-assembly mounted in a lock cylinder body. The carrier sub-assembly is mounted on the plug body and comprises a carrier and a plurality of racks.

To adjust the lock cylinder to fit with different keys, an original corresponding key is inserted into the plug body and the plug body is rotated 90° in clockwise to make the carrier slidable in the lock cylinder body between two positions. A tool is then inserted into the plug body to push the carrier with the racks to move in an axial direction and disengage from pins in the lock cylinder body. After removing the original corresponding key and the tool from the plug body, a new key is inserted into the lock cylinder body and is rotated in counterclockwise to make the racks engaging the pins again. Consequently, the lock assembly can fit with the new corresponding key.

However, a specific tool is needed for adjusting the lock assembly of the '242 application, and the tool is not an inherent part of the lock assembly. Therefore, the adjustment of the lock assembly of the '242 application is troublesome and time-consuming.

To overcome the shortcomings, the present invention tends to provide a lock assembly to mitigate or obviate the aforementioned problems.

SUMMARY OF THE INVENTION

The main objective of the invention is to provide a lock assembly that can be adjusted to fit with different keys conveniently and quickly.

The lock assembly comprises a housing, a lock cylinder, an adjusting block and an adjusting assembly. The housing has a cylinder hole defined axially through the housing. The lock cylinder is rotatably and slidably received in the cylinder hole of the housing and has a key hole, a plurality of pin slots and a holding recess. The pin slots and the holding recess are communicating with the key hole of the lock cylinder. The adjusting block is slidably received in the holding recess of the lock cylinder and has a wedge side facing the lock cylinder and a plurality of first wedge elements formed on the wedge side. The adjusting assembly is mounted in the lock cylinder and comprises multiple adjustable rack assemblies mounted respectively in the pin slots in the lock cylinder. Each rack assembly comprises a rack element and an adjusting base. The rack element is slidably mounted in one of the pin slots, is inverse U-shaped and has a supporting arm, a wedge leg, an engaging leg, a second wedge element and multiple teeth. The supporting arm has two ends. The wedge leg and engaging leg are formed respectively on and protrude downward from the ends of the supporting arm. The second wedge element formed on the wedge leg and selectively engaging one of the first wedge elements on the adjusting block. The multiple teeth are formed on the engaging leg. The adjusting base is slidably mounted in a corresponding pin slot and has multiple teeth selectively engaging the teeth on the rack Other objects, advantages and novel features of the invention will become more apparent from the following detailed description when taken in conjunction with the accompanying drawings.

DETAILED DESCRIPTION OF PREFERRED EMBODIMENT

Figure 1:
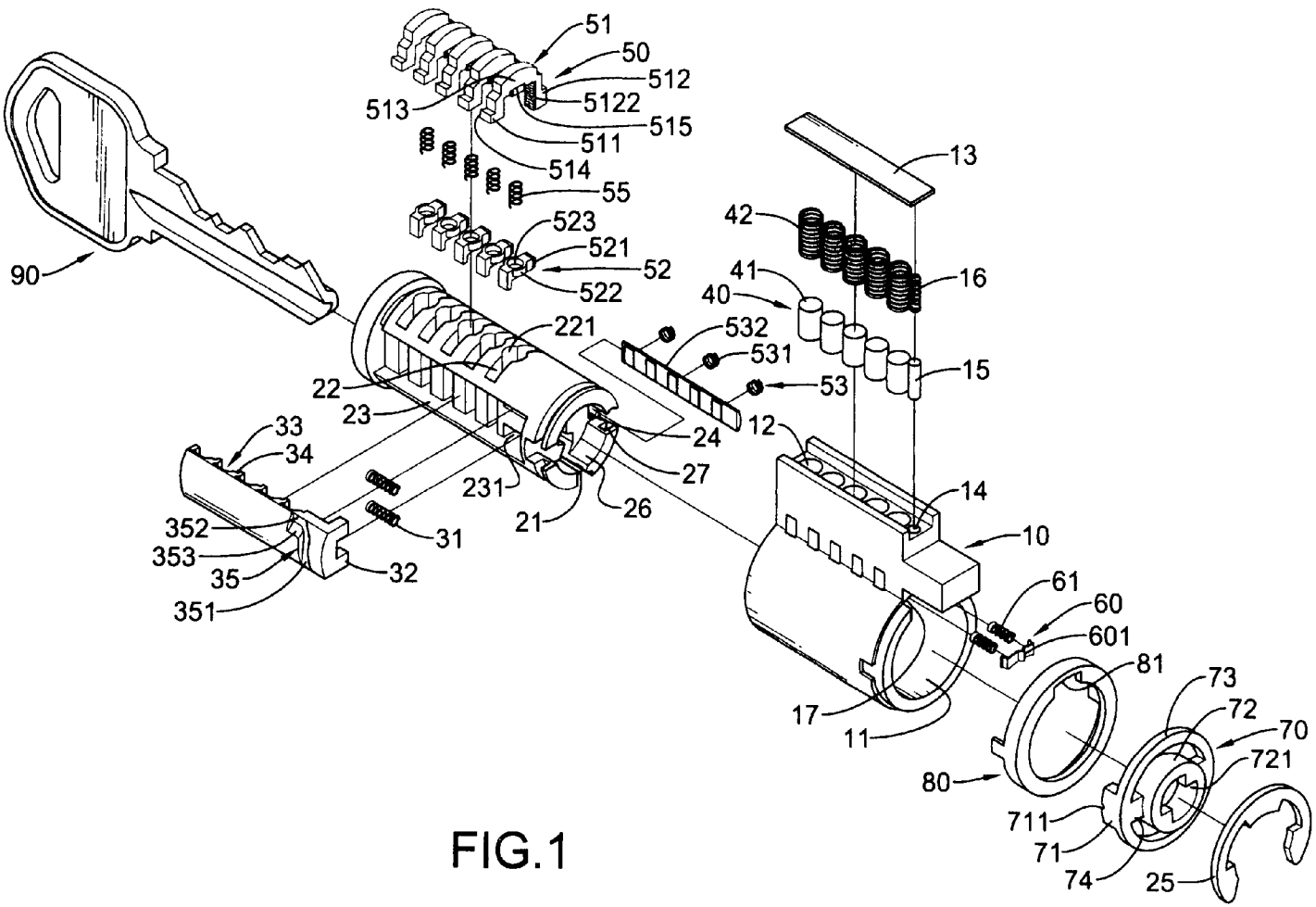
FIG. 1 is an exploded perspective view of a first embodiment of a lock assembly in accordance with the present invention.
Figure 2:
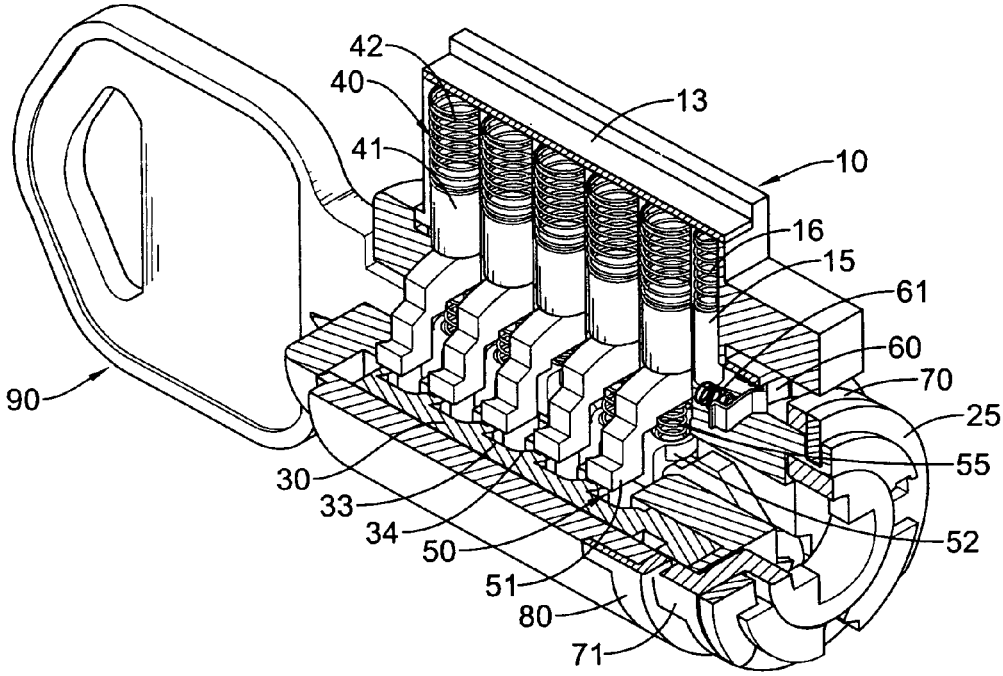
FIG. 2 is a perspective view in partial section of the lock assembly in FIG. 1.
Figure 3:
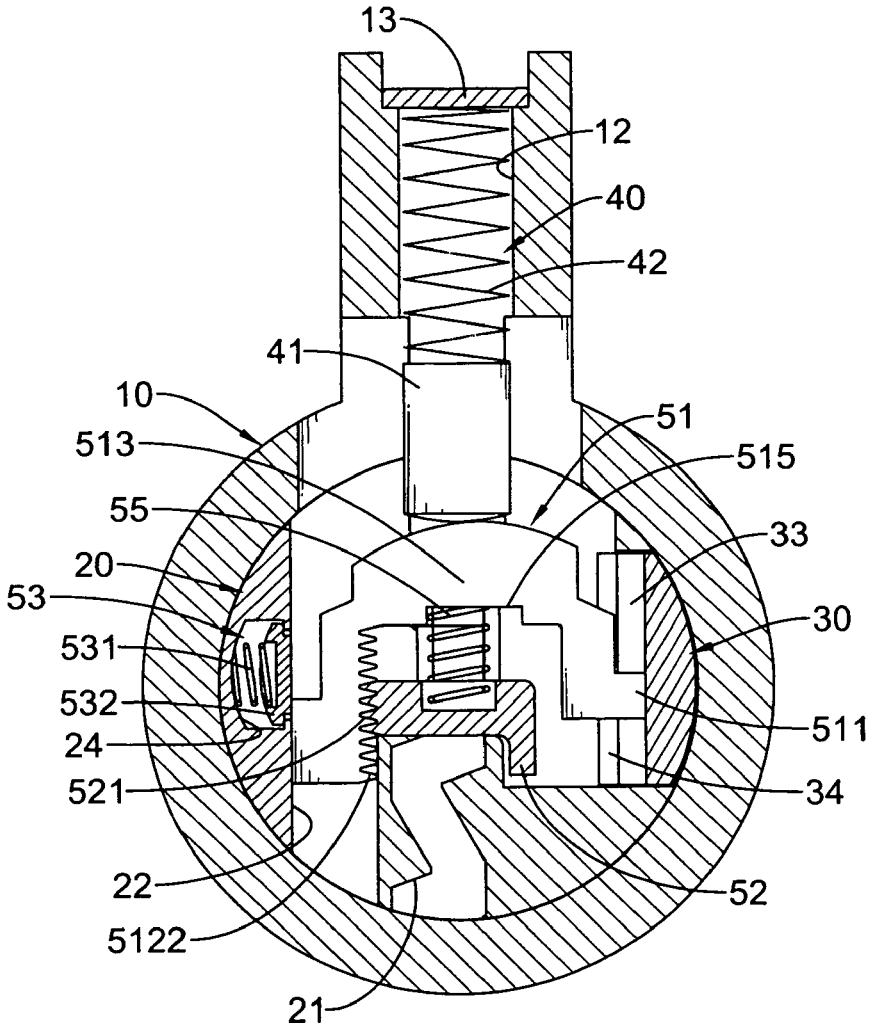
FIG. 3 is a side view in partial section of the lock assembly in FIG. 1 showing that the lock assembly is in a locked condition.

With reference to FIGS. 1 to 3, a lock assembly in accordance with the present invention comprises a housing (10), a lock cylinder (20), an adjusting block (30), multiple pin assemblies (40) and an adjusting assembly.

The housing (10) has a cylinder hole (11), multiple pin holes (12), a lid (13), a through hole (14), an engaging member (15) and a positioning element (60).

The cylinder hole (11) is defined axially through the housing (10). The pin holes (12) are defined radially in the housing (10) and communicate with the cylinder hole (11). The lid (13) is attached to the housing (10) and closes the pin holes (12). The through hole (14) is defined radially in the housing (10), communicates with the cylinder hole (11) and may align with the pin holes (12).

The engaging member (15) is mounted in the through hole (14), may be a stud and further comprises a spring (16). The spring (16) is mounted in the through hole (14) and abuts and pushes the engaging member (15).

The positioning element (60) is mounted on and extends from the housing (10). In a preferred embodiment, an alignment notch (17) is defined in a rear end of the housing (10), and the positioning element (60) is held in and extends out of the alignment notch (17). At least one spring (61) is mounted in the alignment notch (17) and abuts the positioning element (60) to push the positioning element (60) out of the alignment notch (17). The positioning element (60) may have a positioning tip (601) formed on and protruding from the positioning element (60).

The housing (10) further has an annular cap (80) mounted on the rear end of the housing (10) and is made of wear-resisting material. The annular cap (80) has an aligning notch (81) aligning with the alignment notch (17) in the housing (10).

The lock cylinder (20) is rotatably and slidably mounted in the cylinder hole (11) in the housing (10) and comprises a key hole (21), multiple pin slots (22), a holding recess (23), a dungeon (26), a recoiling channel (24), a positioning collar (70) and a fastener (25).

The key hole (21) is defined axially through the lock cylinder (20). The pin slots (22) are defined radially in the lock cylinder (20), communicate with the key hole (21) and selectively and respectively correspond to and align with the pin holes (12) in the housing (10). Each pin slot (22) further has a pin bore (221) defined in an inner surface of the pin slot (22) and having a diameter larger than a width of the pin slot (22). The holding recess (23) is longitudinally defined in the lock cylinder (20) and communicates with the pin slots (22). The holding recess (23) has a spring cavity (231) defined in a bottom at an end of the channel (23). The dungeon (26) is defined in the rear end of the lock cylinder (20) and has at least one slit (27) defined in the rear end of the lock cylinder (20) and communicating with the dungeon (26). The recoiling channel (24) is defined longitudinally inside the lock cylinder (20) and communicates with the pin slots (22) and the dungeon (26).

The positioning collar (70) is mounted securely around the rear end of and rotated with the lock cylinder (20), may abut the annular cap (80) and comprises an inner ring (72), an outer ring (73), at least one connecting rib (74) and a positioning portion (71). With the wear-resisting annular cap (80), the positioning collar (70) is kept from contacting with the rear end of the housing (10), such that the housing (10) is prevented from being worn off.

The inner ring (72) is held inside the dungeon (26) in the lock cylinder (20) and has a connecting hole (721) defined through the inner ring (72). The connecting hole (721) may have a shape of character 8 and is adapted to connect with a lock latch to make the latch rotating with the lock cylinder (20) with the transmission of the positioning collar (70).

The outer ring (73) is mounted around the inner ring (72) and the rear end of the lock cylinder (20). The at least one connecting rib (74) is mounted between the inner and outer rings (72,73) to connect the rings (72,73) together and is held respectively in the at least one slit (27) in the lock cylinder (20). With the engagement between the ribs (74) and the slits (27), the positioning collar (70) is rotated with the lock cylinder (20).

The positioning portion (71) is formed on and protrudes from the positioning collar (70) and selectively engages the positioning element (60) in the alignment notch (17) of the housing (10). The positioning portion (71) may have a positioning detent (711) defined in the positioning portion (71) at an end facing the positioning element (60) and selectively engaging the positioning tip (601) on the positioning element (60) via the aligning notch (81) in the annular cap (80).

The fastener (25) is C-shaped or E-shaped and attached to the rear end of the lock cylinder (20) to keep the lock cylinder (20) from escaping from the cylinder hole (11) in the housing (10) and hold the positioning collar (70) in position at the lock cylinder (20).

The adjusting block (30) is slidably mounted on the lock cylinder (20), is preferably mounted in the holding recess (23) and has a wedge side, an engaging side, multiple first wedge elements (33), an engaging slot (35), at least one biasing member (31) and a spring mount (32).

The wedge side faces the lock cylinder (20), and the engaging side is opposite to the wedge side. The first wedge elements (33) are formed on the wedge side and correspond respectively to the pin slots (22) in the lock cylinder (20).

The first wedge elements (33) are formed separately on the wedge side of the adjusting block (30) and each first wedge element (33) on the adjusting block (30) comprises an inclined guiding face (34) defined in a rear side of the first wedge element (33).

The engaging slot (35) is defined in the engaging side of the adjusting block (30) and selectively engages the engaging member (15) to keep the adjusting block (30) from moving with the lock cylinder (20). The engaging slot (35) has two long edges (351) perpendicular to an axis of the adjusting block (30) and two short edges perpendicular to the long edges (351).

The engaging slot (35) may have a guiding notch (352) defined in one of the short edges to make the slot (35) substantially L-shaped and provides a guiding effect to the engaging member (15) entering into or escaping from the slot (35). With the arrangement of the guiding notch (352), the escape of the engaging member (15) from the slot (35) can be postponed. The guiding notch (352) has an inclined guiding surface (353) extending to the engaging slot (35) to provide a guiding effect to the engaging member (15).

The spring mount (32) is formed on one end of the adjusting block (30).

The biasing members (31), such as springs are mounted in the spring cavity (231) in the holding recess (23) and each have two end abut respectively the spring mount (32) on the adjusting block (30) and an inner surface of the spring cavity (231).

The lock pin assemblies (40) are mounted respectively in the pin holes (12) in the housing (10) and selectively extend respectively into the pin slots (22) in the lock cylinder (20), preferably extend into the pin bores (221) in the pin slots (22). Each lock pin assembly (40) comprises a lock pin (41) and a spring (42). The lock pin (41) is slidably mounted in one of the pin holes (12) in the housing (10) and selectively extends into the pin bore (221) of a corresponding one the pin slots (22) in the lock cylinder (20). The spring (42) is held in a corresponding pin hole (12) and abuts against the lock pin (41) and the lid (13) to push the lock pin (41) into the corresponding pin slot (22).

The adjusting assembly is mounted in the lock cylinder (20) and comprises multiple rack assemblies (50) and a recoiling device (53).

The rack assemblies (50) are adjustable and are mounted respectively in the pin slots (22) in the lock cylinder (20) to support the lock pins (41) of the lock pin assemblies (40). Each rack assembly (50) comprises a rack element (51), an adjusting base (52) and a resilient member (55).

The rack element (51) may be inverse U-shaped, is slidably mounted in one of the pin slots (22), selectively abuts with and supports a corresponding one of the lock pins (41) and has a supporting arm (513), a wedge leg (511) and an engaging leg (512). The supporting arm (513) has a spring cavity (515) defined in a bottom of the supporting arm (513). The wedge leg (511) and the engaging leg (512) are formed respectively on and protrude downward from two ends of the supporting arm (513).

The wedge leg (511) extends into the holding recess (23) and corresponds to and selectively engages one of the first wedge elements (33) on the adjusting block (30). The wedge leg (511) has a second wedge element (514) formed on the wedge leg (511) and selectively engages a corresponding first wedge element (33) on the adjusting block (30).

The engaging leg (512) has multiple teeth (5122) formed on a side facing the wedge leg (511).

The adjusting base (52) is slidably mounted in a corresponding pin slot (22) and has multiple teeth (521) engaging the teeth (5122) on the rack element (51) and a spring abutting portion (522). With the engagement between the teeth (5122, 521) on the rack element (51) and the adjusting base (52), the rack element (51) will move with the adjusting base (52) along the corresponding pin slot (22).

The spring abutting portion (522) is formed on the adjusting base (52) and has a round cavity (523) defined in the spring abutting portion (522).

The resilient member (55) is mounted between the rack element (51) and the adjusting base (52). In a preferred embodiment, two ends of the resilient member (55) are held respectively in the spring cavity (515) in the extension arm (513) and the cavity (523) in the spring abutting portion (522) on the adjusting base (52).

Figure 4:
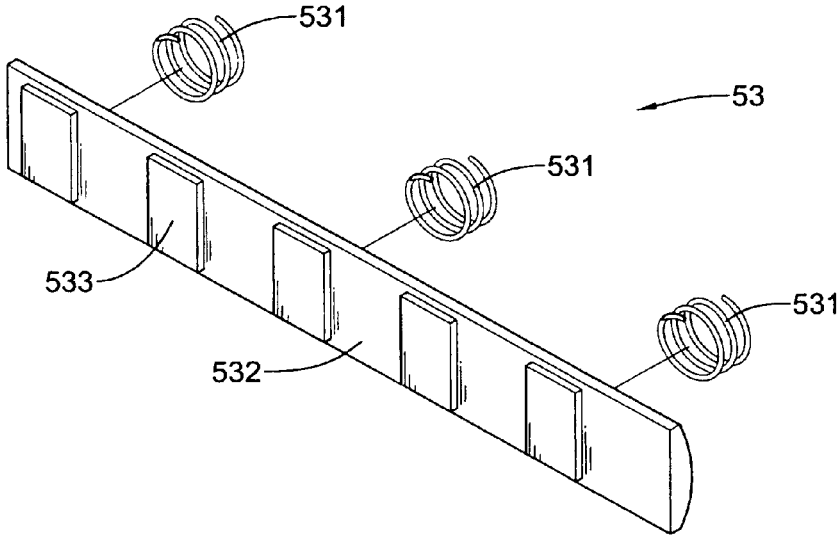
FIG. 4 is an exploded perspective view of the recoiling device of the lock assembly in FIG. 1.

The recoiling device (53) is mounted in the recoiling channel (24) in the lock cylinder (20) to provide a recoiling force to the rack elements (51) and comprises a pushing rod (532) and multiple resilient elements (531). With further reference to FIG. 4, the pushing rod (532) has multiple pushing bosses (533) formed on one side of the pushing rod (532) and abutting respectively with the engaging legs (512) of the rack elements (51). The resilient elements (531), such as springs abut with the pushing rod (532).

Figure 5:
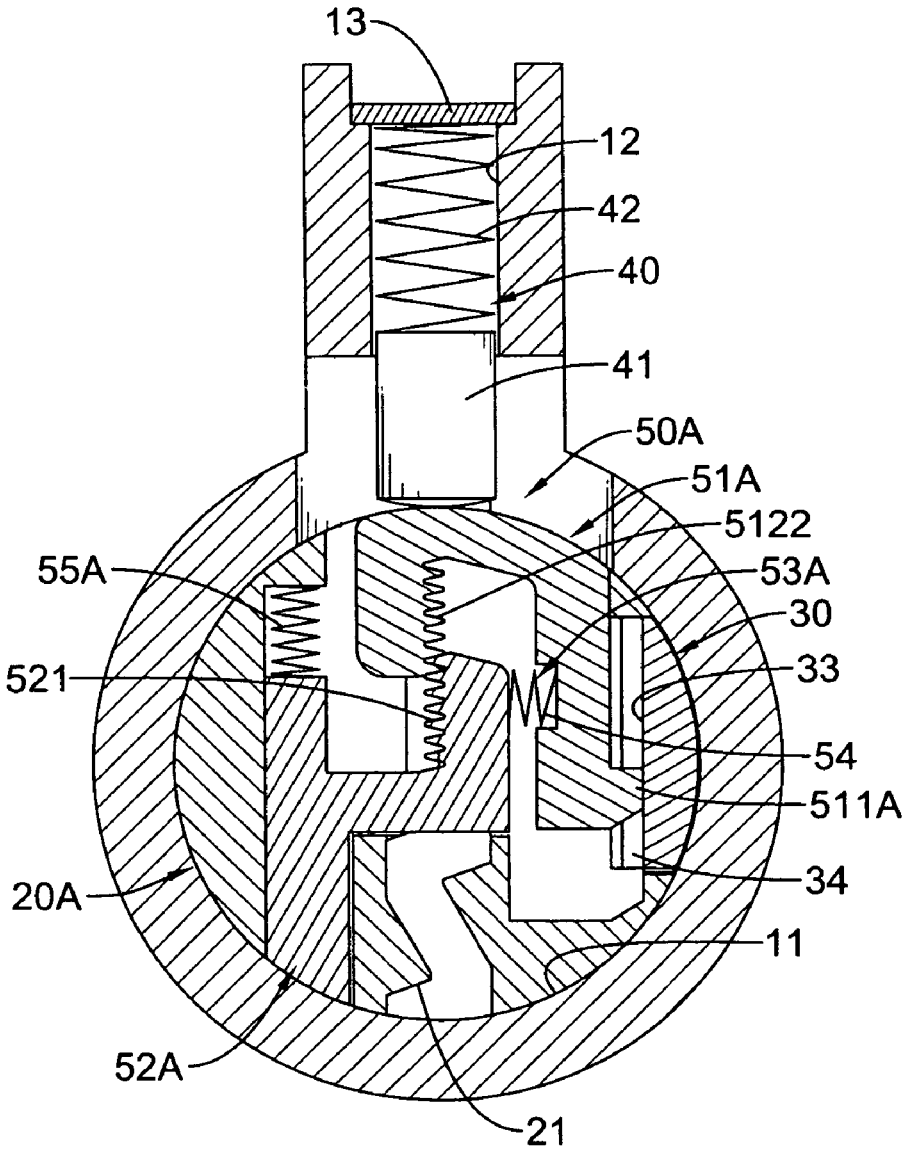
FIG. 5 is a side view in partial section of a second embodiment of a lock assembly in accordance with the present invention.

In an alternative embodiment, with reference to FIG. 5, the recoiling device (53) comprises multiple resilient elements (54) each mounted between the wedge leg (511A) of a corresponding rack element (51A) and the corresponding adjusting base (52A). The resilient member (55A) of each rack assembly (50A) is mounted between the adjusting base (52A) and an inner surface of the lock cylinder (20A). In a preferred embodiment, two ends of the resilient member (54) are held respectively in the spring cavity (515) in the extension arm (513) and the cavity (523) in the spring abutting portion (522) on the adjusting base (52).

In use, with reference to FIG. 3, before a specific key is inserted into the key hole (21), the lock pins (41) extend respectively into the pin bores (221) of the lock slots (22) in the lock cylinder (20). Thus, the interface between the housing (10) and the lock cylinder (20) is blocked by the lock pins (41) to keep the lock cylinder (20) from rotating relative to the housing (10), and the lock assembly is in a lock condition.

When a specific key (90) is inserted into the key hole (21), with reference to FIG. 2, the key pushes the adjusting bases (52) with the rack elements (51) to move upward along the pin slots (22) to a position where the joints between the lock pins (41) and the rack elements (51) align with the interface between the lock cylinder (20) and the housing (10). Consequently, the lock cylinder (20) can be rotated, and the lock assembly is in an unlocked condition.

Figure 6B:
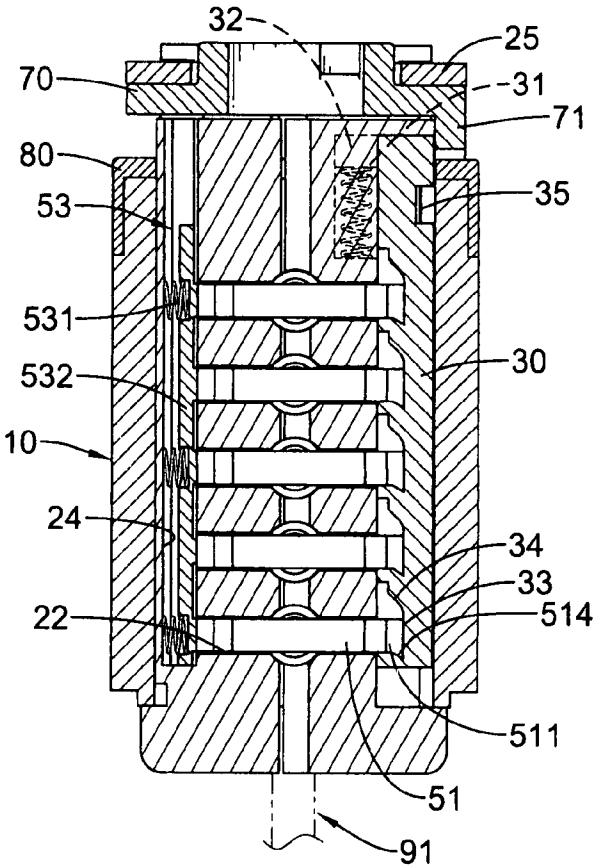
FIGS. 6 to 12 are top and side views in partial section of the lock assembly in FIG. 1 showing the process of the lock assembly being adjusted to fit with different keys.
Figure 6A:
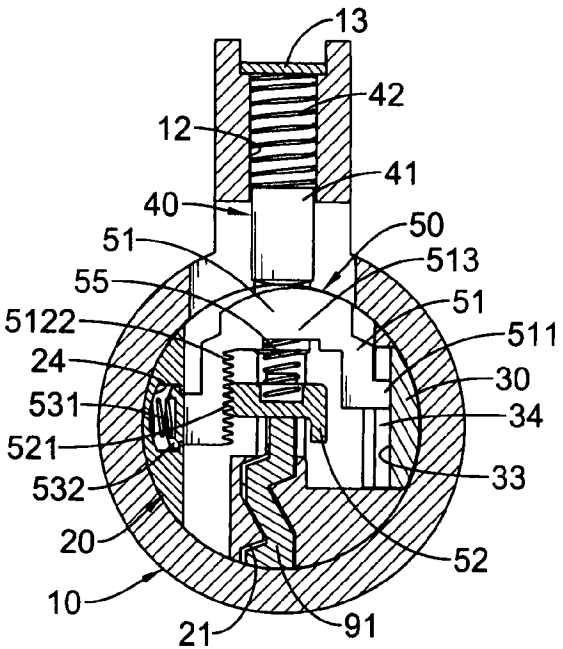
Figure 7A:
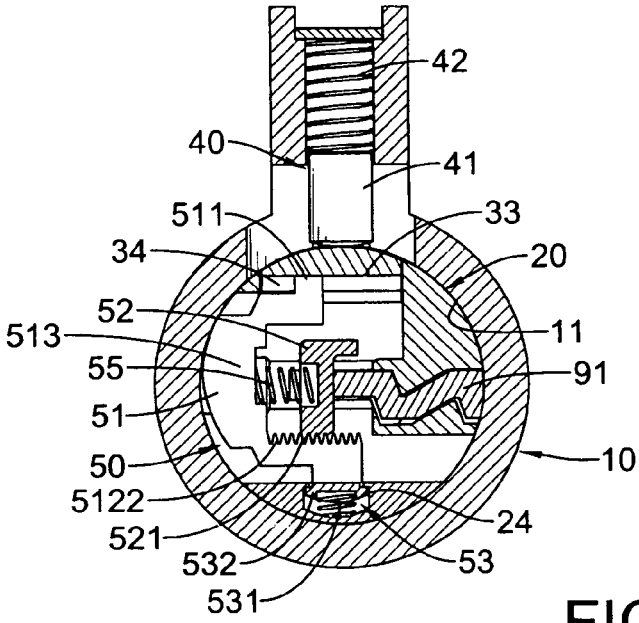
Figure 7B:
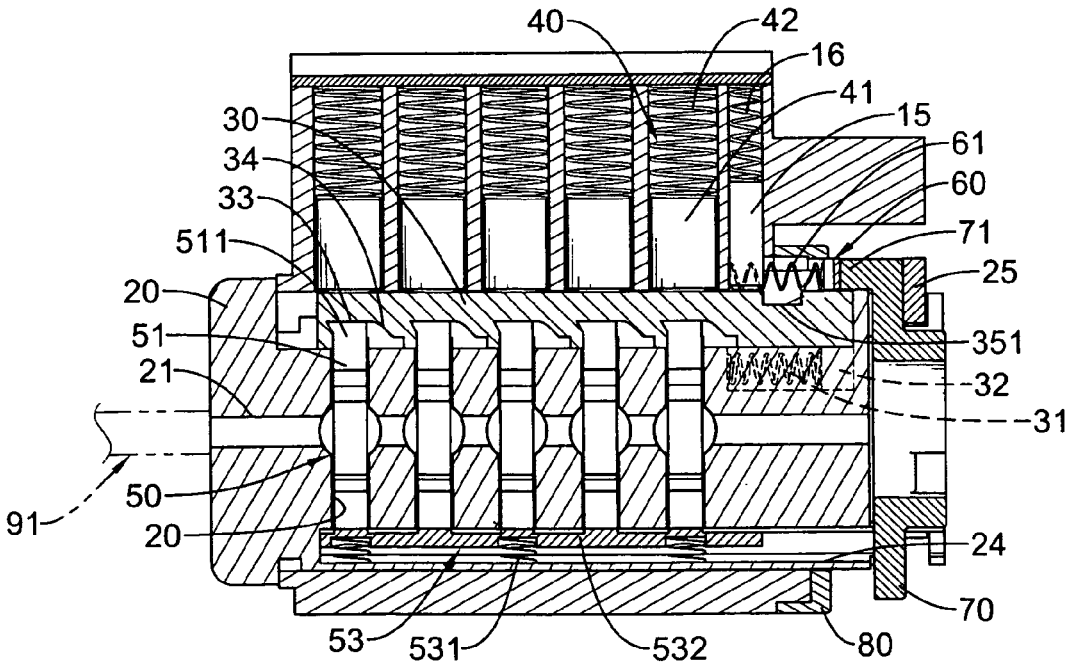

To adjust the lock assembly to fit with different keys, with reference to FIGS. 6 to 12, a first key (91) is inserted into the key hole (21) to unlock the lock assembly as shown in FIGS. 6A and B. The lock cylinder (20) is then rotated to a position where the positioning position (71) on the positioning collar (70) aligns and engages the positioning element (60) as shown in FIGS. 7A and B. At the same time, the engaging slot (35) in the adjusting block (30) corresponds to and aligns with the engaging device (15). The engaging device (15) enters into the guiding notch (352) from a corresponding short edge of the engaging slot (35). With the engagement between the positioning portion (71) on the positioning collar (70) and the positioning element (60), the necessary rotating angle of the lock cylinder (20) for aligning the adjusting block (30) with the engaging device (15) is determined.

Figure 8:
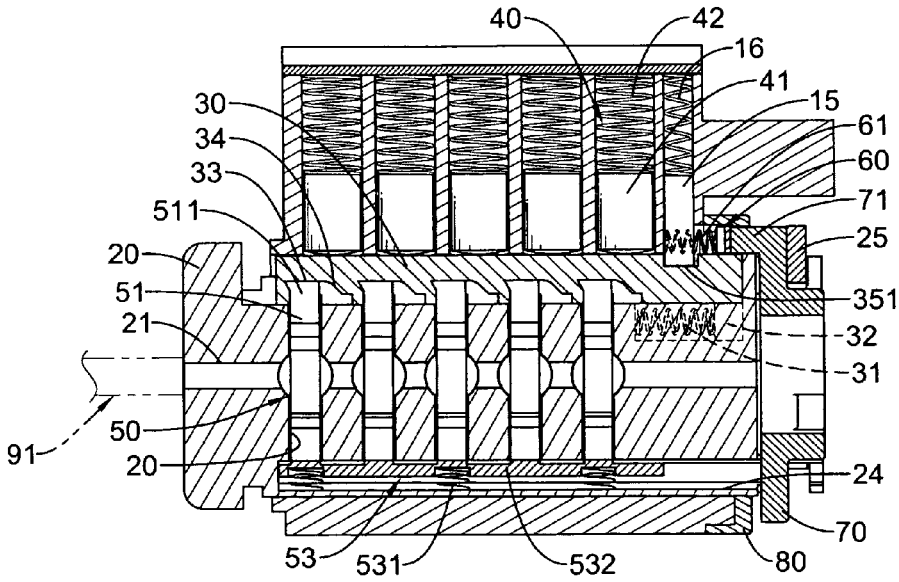

The lock cylinder (20) is moved, such as pulled to slide in the cylinder hole (101) to make the engaging device (15) entering into and engaging the engaging slot (35) with the guiding effect provided by the inclined guiding surface (353) and the pushing force provided by the spring (16) as shown in FIG. 8. With the engagement between the engaging device (15) and the slot (35), the adjusting block (30) is kept from moving with the lock cylinder (20).

Figure 9A:
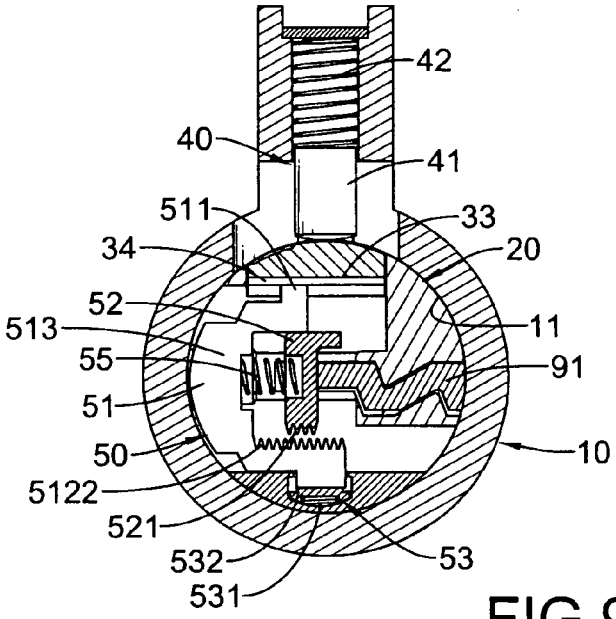
Figure 9B:
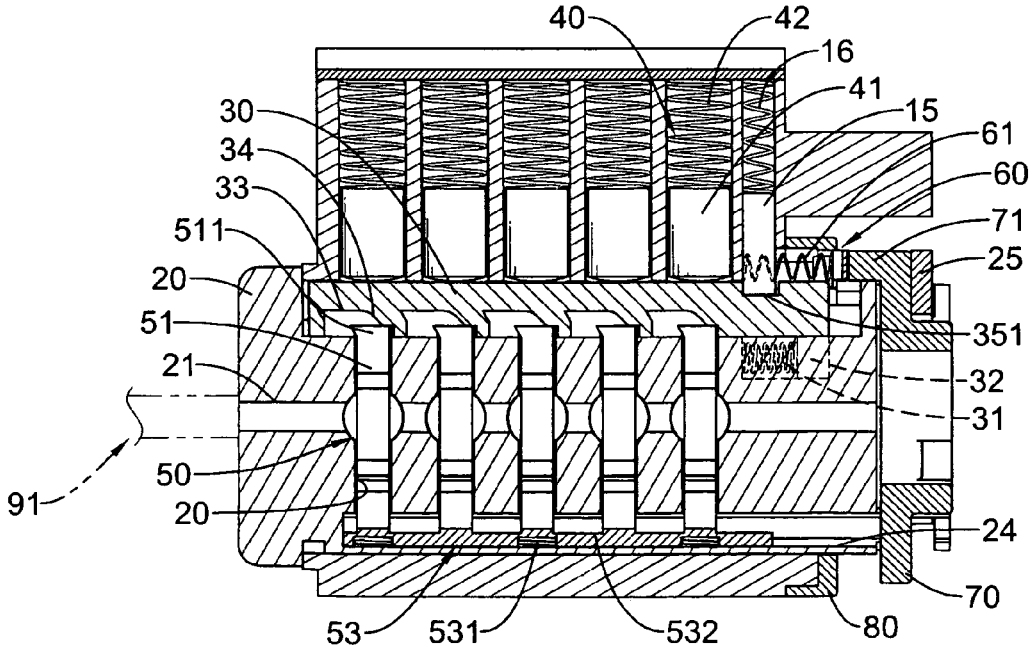

The lock cylinder (20) is then moved in a reverse direction, such as pushed, the adjusting block (30) is kept stationary and the rack elements (51) are moved with the lock cylinder (20) and relative to the adjusting block (30). Consequently, the rack elements (51) will move away from the adjusting bases (52) with the inclined guiding faces (34) of the first wedge elements (33) on the adjusting block (30) as shown in FIGS. 9A and B. Thus, the rack elements (51) are disengaged from the adjusting bases (52).

Figure 10:
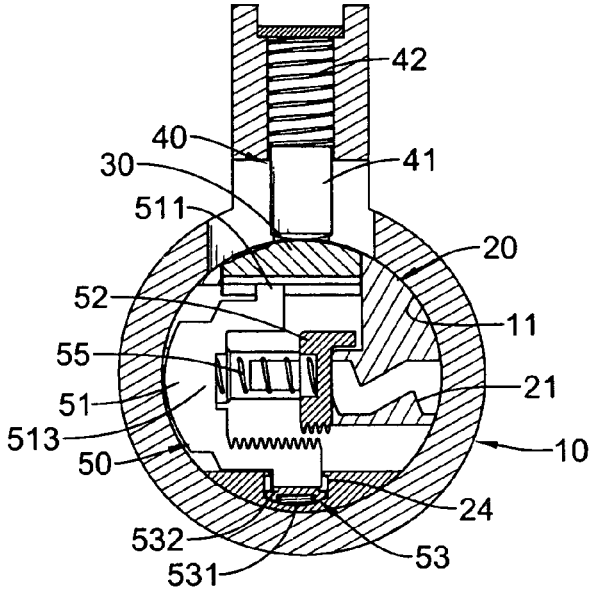

The first key (91) is removed from the key hole (21), as shown in FIG. 10.

Figure 11:
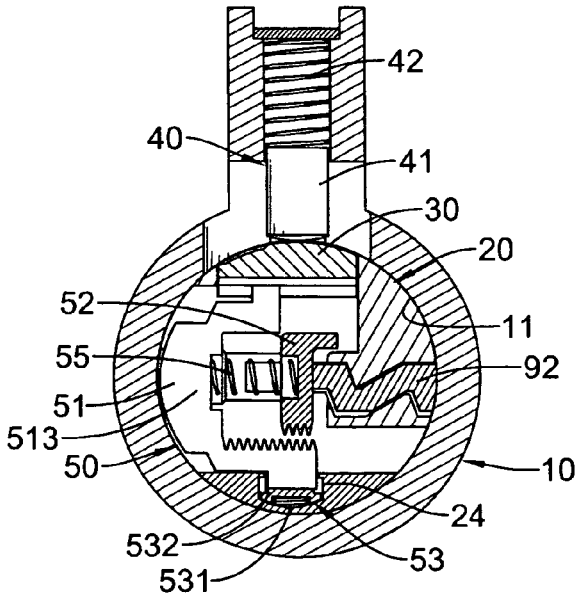

A second key (92) is then inserted into the key hole (21) to support the adjusting bases (52) at different positions from those supported by the first key (91) as shown in FIG. 11.

Figure 12B:
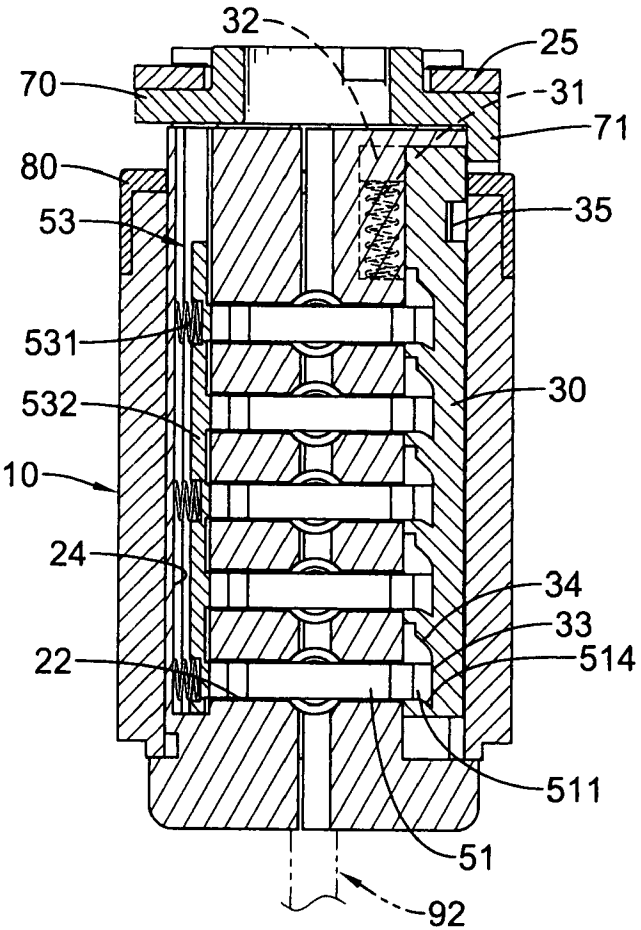
Figure 12A:
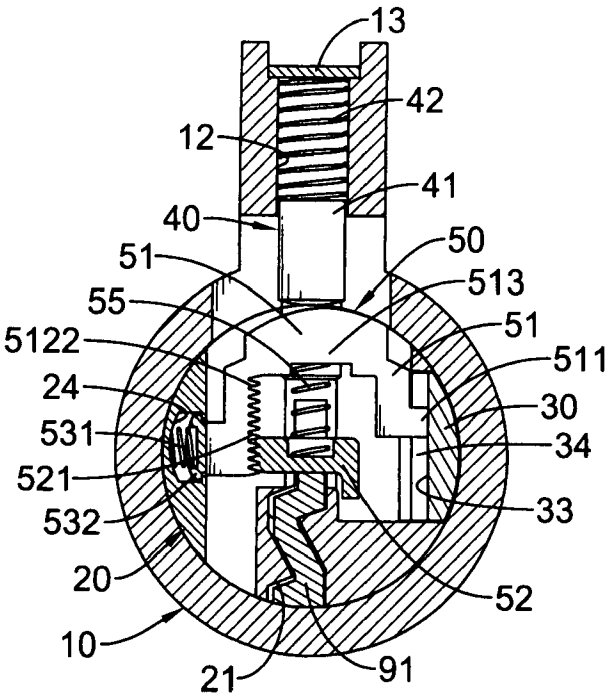

Finally, the lock cylinder (20) is rotated by the second key (92) as shown in FIGS. 12A and B. With the rotation of the lock cylinder (20), the adjusting block (30) will disengage from the engaging device (15) and move to an original position with the force provided by the biasing members (31). With the movement of the adjusting block (30), the rack elements (51) are pushed to move close to and engage the adjusting bases (52). Because the adjusting bases (52) are located at different positions, the teeth (521) on the adjusting bases (52) engage different teeth (5122) on the rack elements (51). Thus, the rack elements (51) support the lock pins (41) at different positions to fit with the second key (91). Additionally, with the recoiling force provided by the recoiling device (53), the rack elements (51) can be moved to engage the adjusting bases (52) precisely and stably.

Accordingly, to adjust the lock assembly in accordance with the present invention is convenient and quick without using any tool, so that the lock assembly is versatile in use.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A lock assembly comprising:

a housing having a cylinder hole defined axially through the housing;

a lock cylinder rotatably and slidably received in the cylinder hole of the housing and having a key hole, a plurality of pin slots and a holding recess, wherein the pin slots and the holding recess are communicating with the key hole of the lock cylinder;

an adjusting block slidably received in the holding recess of the lock cylinder and having a wedge side facing the lock cylinder and a plurality of first wedge elements formed on the wedge side; and an adjusting assembly mounted in the lock cylinder and comprising multiple adjustable rack assemblies mounted respectively in the pin slots in the lock cylinder and each rack assembly comprising a rack element slidably mounted in one of the pin slots, being inverse U-shaped and having a supporting arm having two ends;

a wedge leg and an engaging leg formed respectively on and protruding downward from the ends of the supporting arm;

a second wedge element formed on the wedge leg and selectively engaging one of the first wedge elements on the adjusting block; and multiple teeth formed on the engaging leg; and an adjusting base slidably mounted in a corresponding pin slot and having multiple teeth selectively engaging the teeth on the rack element.

2. The lock assembly as claimed in claim 1, wherein each rack assembly further has a resilient member mounted between the rack element and the adjusting base of the rack assembly.

3. The lock assembly as claimed in claim 2, wherein the supporting arm of the rack element of each rack assembly has a spring cavity defined in a bottom of the supporting arm;

the adjusting base of each rack assembly further has a spring abutting portion formed on the adjusting base and a round cavity defined in the spring abutting portion; and the resilient member of each rack assembly has two ends held respectively in the spring cavity in the supporting arm of a corresponding rack element and the cavity in the spring abutting portion on a corresponding adjusting base.

4. The lock assembly as claimed in claim 3, wherein each first wedge element on the adjusting block has an inclined guiding face; and the second wedge element of the rack element of each rack assembly is a wedge formed on the wedge leg and selectively engaging a corresponding first wedge element on the adjusting block.

5. The lock assembly as claimed in claim 1, wherein the housing has multiple pin holes defined radially in the housing and communicating with the cylinder hole; and a lid attached to the housing and closing the pin holes;

the lock assembly further has multiple lock pin assemblies mounted respectively in the pin holes in the housing, selectively extending respectively into the pin slots in the lock cylinder and each comprising a lock pin slidably mounted in one of the pin holes in the housing, selectively extending into a corresponding one of the pin slots in the lock cylinder and selectively abutting and supported on the rack element of one of the adjustable rack assemblies; and a spring held in a corresponding pin hole and abutting against the lock pin and the lid on the housing; and the rack elements selectively abut respectively with and support the lock pins.

6. The lock assembly as claimed in claim 5, wherein the housing further has a through hole defined in the housing near a rear end of the housing; and an engaging member mounted in the through hole in the housing and having an engaging stud mounted in the through hole in the housing and extending into the cylinder hole through the through hole in the housing; and a spring mounted in the through hole in the housing and abutting the engaging stud; and the adjusting block further has an engaging side opposite to the wedge side; and an engaging slot defined in the engaging side and selectively engaging the engaging stud.

7. The lock assembly as claimed in claim 6, wherein the engaging slot has two long edges perpendicular to an axis of the adjusting block;

two short edges perpendicular to the long edges; and a guiding notch defined in one of the short edges to make the slot substantially L-shaped and provides a guiding effect to the engaging member entering into or escaping from the slot and having an inclined guiding surface.

8. The lock assembly as claimed in claim 1, wherein the holding recess has a spring cavity defined in a bottom at an end of the holding recess;

the adjusting block further has a spring mount formed on one end of the adjusting block; and at least one biasing member is mounted in the spring cavity in the holding recess and each one of the at least one biasing member has two ends abutting respectively the spring mount on the adjusting block and an inner surface of the spring cavity.

9. The lock assembly as claimed in claim 1, wherein the housing further has an alignment notch defined in a rear end of the housing;

a positioning element held in the alignment notch; and at least one spring mounted in the alignment notch and abutting the positioning element;

a positioning collar is mounted securely around and rotated with the lock cylinder and has a positioning portion formed on and protruding from the positioning collar and selectively engaging the positioning element in the alignment notch of the housing.

10. The lock assembly as claimed in claim 9, wherein the positioning element has a positioning tip formed on and protruding from the positioning element at an end facing the positioning collar; and the positioning portion on the positioning collar has a positioning detent defined in the positioning portion at an end facing the positioning element and selectively engaging the positioning tip on the positioning element.

11. The lock assembly as claimed in claim 10, wherein the lock cylinder further has a fastener attached to a rear end of the lock cylinder and abutting the positioning collar to keep the lock cylinder from escaping from the housing.

12. The lock assembly as claimed in claim 11, wherein the housing further has an annular cap mounted on the rear end of the housing between the housing and the positioning collar.

13. The lock assembly as claimed in claim 12, wherein the lock cylinder further has a dungeon defined in the rear end of the lock cylinder and at least one slit defined in the rear end of the lock cylinder and communicating with the dungeon;

the positioning collar comprises an inner ring held inside the dungeon in the lock cylinder and having a connecting hole defined through the inner ring;

an outer ring mounted around the inner ring and the rear end of the lock cylinder; and at least one connecting rib mounted between the inner and outer rings to connect the rings together and held respectively in the at least one slit in the lock cylinder.

14. The lock assembly as claimed in claim 13, wherein the connecting hole in the inner ring of the positioning collar has a general shape of character 8.

15. The lock assembly as claimed in claim 14, wherein the annular cap has an aligning notch aligning with the alignment notch in the housing; and the positioning portion on the positioning collar extends through the aligning notch in the annular cap.

16. The lock assembly as claimed in claim 1, wherein the adjusting assembly further comprises a recoiling device to provide a recoiling force to the rack elements and having multiple resilient elements each mounted between a corresponding one of the rack elements and a corresponding adjusting base.

17. The lock assembly as claimed in claim 1, wherein the lock cylinder further has a recoiling channel defined longitudinally inside the lock cylinder and communicating with the pin slots; and the adjusting assembly further comprises a recoiling device mounted in the recoiling channel to provide a recoiling force to the rack elements.

18. The lock assembly as claimed in claim 17, wherein the recoiling device has a pushing rod having multiple pushing bosses formed on one side of the pushing rod and abutting respectively with the rack elements; and multiple resilient elements abutting with the pushing rod.

* * * * *